US008415004B2

(12) United States Patent
Lee et al.

(10) Patent No.: US 8,415,004 B2
(45) Date of Patent: Apr. 9, 2013

(54) LOW THERMAL-IMPEDANCE INSULATED METAL SUBSTRATE AND METHOD FOR MANUFACTURING THE SAME

(75) Inventors: Yu-Hsien Lee, Kaohsiung (TW); Chen-Hsin Huang, Kaohsiung (TW); Feng-Jung Tien, Kaohsiung (TW); Tzu-Ching Hung, Kaohsiung (TW)

(73) Assignee: Taiflex Scientific Co., Ltd., Kaohsiung (TW)

( * ) Notice: Subject to any disclaimer, the term of this patent is extended or adjusted under 35 U.S.C. 154(b) by 548 days.

(21) Appl. No.: 12/617,595

(22) Filed: Nov. 12, 2009

(65) Prior Publication Data

US 2011/0111191 A1 May 12, 2011

(51) Int. Cl.
*B32B 7/02* (2006.01)
*B32B 5/00* (2006.01)
*B21D 53/02* (2006.01)

(52) U.S. Cl. ..... 428/213; 428/336; 428/335

(58) Field of Classification Search ..... 428/213, 428/336, 335; 29/890.039
See application file for complete search history.

(56) References Cited

U.S. PATENT DOCUMENTS

2005/0104214 A1* 5/2005 Maeda et al. ..... 257/747
2008/0073623 A1* 3/2008 Wang et al. ..... 252/567

* cited by examiner

*Primary Examiner* — David Sample
*Assistant Examiner* — Tahseen N Khan
(74) *Attorney, Agent, or Firm* — Hershkovitz & Associates, LLC; Abraham Hershkovitz

(57) ABSTRACT

A method for manufacturing a low thermal-impedance insulated metal substrate has steps of providing an electrical-conductive metal layer; forming a first thermal-conductive polymeric composite layer on the electrical-conductive metal layer; forming a second thermal-conductive polymeric composite layer on the first thermal-conductive polymeric composite layer; and adhere a thermal-conductive metal layer on the second thermal-conductive polymeric composite layer by hot-pressing process. Therefore, the low thermal-impedance insulated metal substrate of the present invention has lower thermal-impedance, lower coefficient of thermal expansion and higher electrical reliability.

8 Claims, 4 Drawing Sheets

LOW THERMAL-IMPEDANCE INSULATED METAL SUBSTRATE AND METHOD FOR MANUFACTURING THE SAME

BACKGROUND OF THE INVENTION

1. Field of Invention

The present invention relates to a method fore manufacturing a low thermal-impedance insulated metal substrate, and more particularly to a method for manufacturing a low thermal-impedance insulated metal substrate with improved lower thermal-impedance and higher electrical reliability to enhance higher life span of an electronic device with the low thermal-impedance insulated metal substrate. The low thermal-impedance insulated metal substrate provides lower thermal expansion the same.

2. Description of the Related Art

Electronic devices are developed to have high efficiency, so more power is required to drive electronic devices. When an electronic device is in operation, heat will be generated from the electronic device and accumulated in the electronic device, damaging the electronic device and shortening a life span and electrical reliability of the electronic device if the heat cannot be dissipated. For example, light emitted diodes (LED) are used as back light units or the like. Especially in the lighting industry, LEDs are actively used to replace incandescent lamps which increase commercial demand for LEDs. However, only 15~25% of electricity input can be converted into light in LEDs and other electricity input is converted into heat. Therefore, the heat accumulates in the LED, which causes decrease of luminous intensity, shortening of life span of the LED, light emitted color-shift and yellowing of packaging or the like.

With reference to FIG. 5, in order to solve the foregoing disadvantages, an electronic element (40) can be mounted on an insulated metal substrate (30) to dissipate heat from the electronic element (40) to a thermal module. A common insulated metal substrate (30) has an electrical-conductive metal layer (31), a thermal-conductive metal layer (33) and an insulation layer (32) with thermal-conductive and adhesive functions between the electrical-conductive metal layer (31) and the thermal-conductive metal layer (33). Generally, there are three conventional methods for manufacturing the insulated metal substrate (30).

The first conventional method comprises steps of mixing inorganic thermal-conductive filler and thermoplastic resin to form a composite solution; coating the composite solution on a surface of the electrical-conductive metal layer (31) and a surface of the thermal-conductive metal layer (33); drying the electrical-conductive metal layer (31) and the thermal-conductive metal layer (33) to form two thermoplastic thermal-conductive composite layers respectively on the electrical-conductive metal layer (31) and the thermal-conductive metal layer (33); adhering the thermoplastic thermal-conductive composite layers of the electrical-conductive metal layer (31) and the thermal-conductive metal layer (33) to form a thermoplastic thermal-conductive composite layers (31, 33); melting the thermoplastic thermal-conductive composite layers (31, 33) by the thermal compressing process, so that the layers (31, 33) can be adhered and combined to form an insulation layer (32) between them and the insulated metal substrate (30) is obtained. However, the process of thermal compression requires a temperature higher than 200° C., and voids or pores are easily generated in interfaces between layers, which increases thermal-impedance of the insulated metal substrate (30).

The second conventional method comprises steps of mixing inorganic thermal-conductive filler and liquid thermosetting resin to form a slurry; coating the slurry on the thermal-conductive metal layer (33) to form a thermal-conductive composite layer; covering the electrical-conductive metal layer (31) on the thermal-conductive composite layer; curing the thermal-conductive composite layer by the hot-press process to form an insulation layer (32). However, since the slurry is liquid state before curing, high temperature and pressure process may cause the resin-flow phenomenon, which the slurry spills out of the layers (31, 33). During manufacturing process, the inorganic thermal-conductive filler and thermosetting liquid resin may be separated into inhomogeneous. Therefore, the insulation layer (32) has poor thermal conductivity and electrical reliability.

The third conventional method comprises steps of blending inorganic thermal-conductive filler, thermoplastic resin and thermosetting resin at a temperature higher than melting points of the resins to form a rubber; adding thermosetting epoxy curing agent and catalyst into the rubber; extruding, calendering, injection molding the rubber and a releasing material to form a thermal-conductive insulating composite layer with the releasing substrate; removing the releasing substrate; putting and pressing the thermal-conductive insulated composite layer between the electrical-conductive metal layer (31) and the thermal-conductive metal layer (33) at increased temperature, which is served as an insulation layer (32); and obtaining the insulated metal substrate (30). After curing process, the resins of the thermal-conductive insulated composite layer form the inter-penetrating network structure. However, to melt the thermoplastic resin requires higher temperature and the inorganic thermal-conductive filler is difficult to be dispersed homogeneously in a high viscosity fluid thermoplastic resin. During the pressing process of the thermal-conductive insulating composite layer, voids or pores are easily formed at interface between each two layers to increase thermal-impedance of the insulated metal substrate (30).

For achieving a suitable electrical reliability, each insulated layer (32) of insulated metal substrate (30) produced by the foregoing methods has a thickness larger than 75 μm. Besides, in order to lower the thermal-impedance, thermal-conductivity of each insulated layer (32) should be raised. Therefore, the inorganic thermal-conductive filler is more than 50 vol. % of the insulated layer (32), which results in decreasing mechanical properties, so the insulated layer (32) will be easily creaked to decrease the electrical reliability.

To overcome the shortcomings, the present invention provides a method for manufacturing a thermal-conductive substrate with lower thermal-impedance to mitigate or obviate the aforementioned.

SUMMARY OF THE INVENTION

The primary objective of the present invention is to provide a method for manufacturing a thermal-conductive substrate with lower thermal-impedance and higher electrical reliability to enhance the life span of an electronic device with the thermal-conductive insulated metal substrate.

To achieve the objective, the method for manufacturing a low thermal-impedance insulated metal substrate in accordance with the present invention comprises steps of providing an electrical-conductive metal layer; forming a first thermal-conductive polymeric composite layer which provides higher electrical reliability on the electrical-conductive metal layer; forming a second thermal-conductive polymeric composite layer which provides a lower temperature hot-pressing function on the first thermal-conductive polymeric composite layer; and hot-pressing a thermal-conductive metal layer on the second thermal-conductive polymeric composite layer.

Therefore, the low thermal-impedance insulated metal substrate of the present invention has lower thermal-impedance, lower coefficient of thermal expansion and higher electrical reliability.

Other objectives, advantages and novel features of the invention will become more apparent from the following detailed description when taken in conjunction with the accompanying drawings.

DETAILED DESCRIPTION OF THE INVENTION

Figure 1:
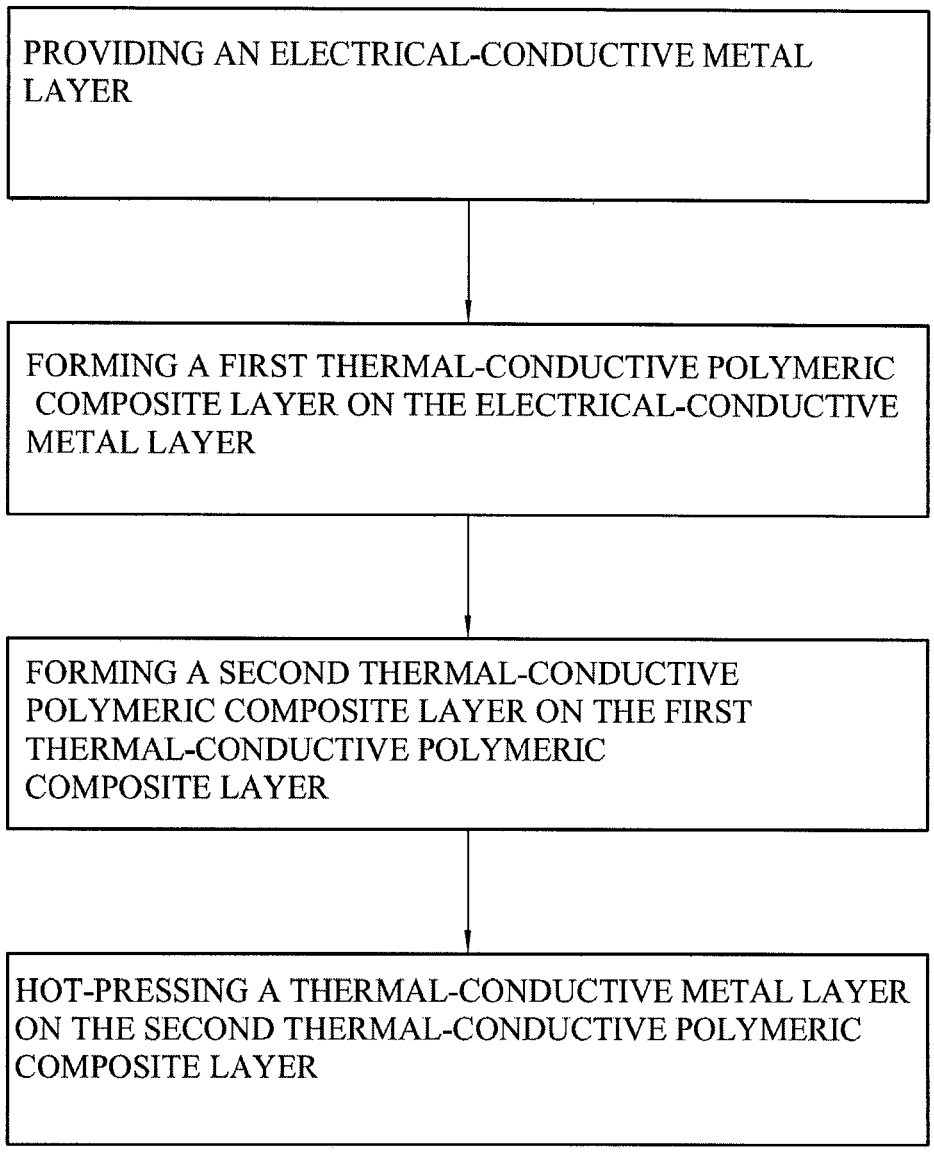
FIG. 1 is a flow chart of a method for manufacturing a low thermal-impedance insulated metal substrate in accordance with the present invention.

With reference to FIG. 1, a method for manufacturing a low thermal-impedance insulated metal substrate, comprises steps of providing an electrical-conductive metal layer (a); forming a first thermal-conductive polymeric composite layer which provides electrical reliability on the electrical-conductive metal layer (b); forming a second thermal-conductive polymeric composite layer which provides hot-pressing process at lower temperature on the first thermal-conductive polymeric composite layer (c); and hot-pressing a thermal-conductive metal layer on the second thermal-conductive polymeric composite layer (d) to obtain the low thermal-impedance insulated metal substrate.

Figure 3:
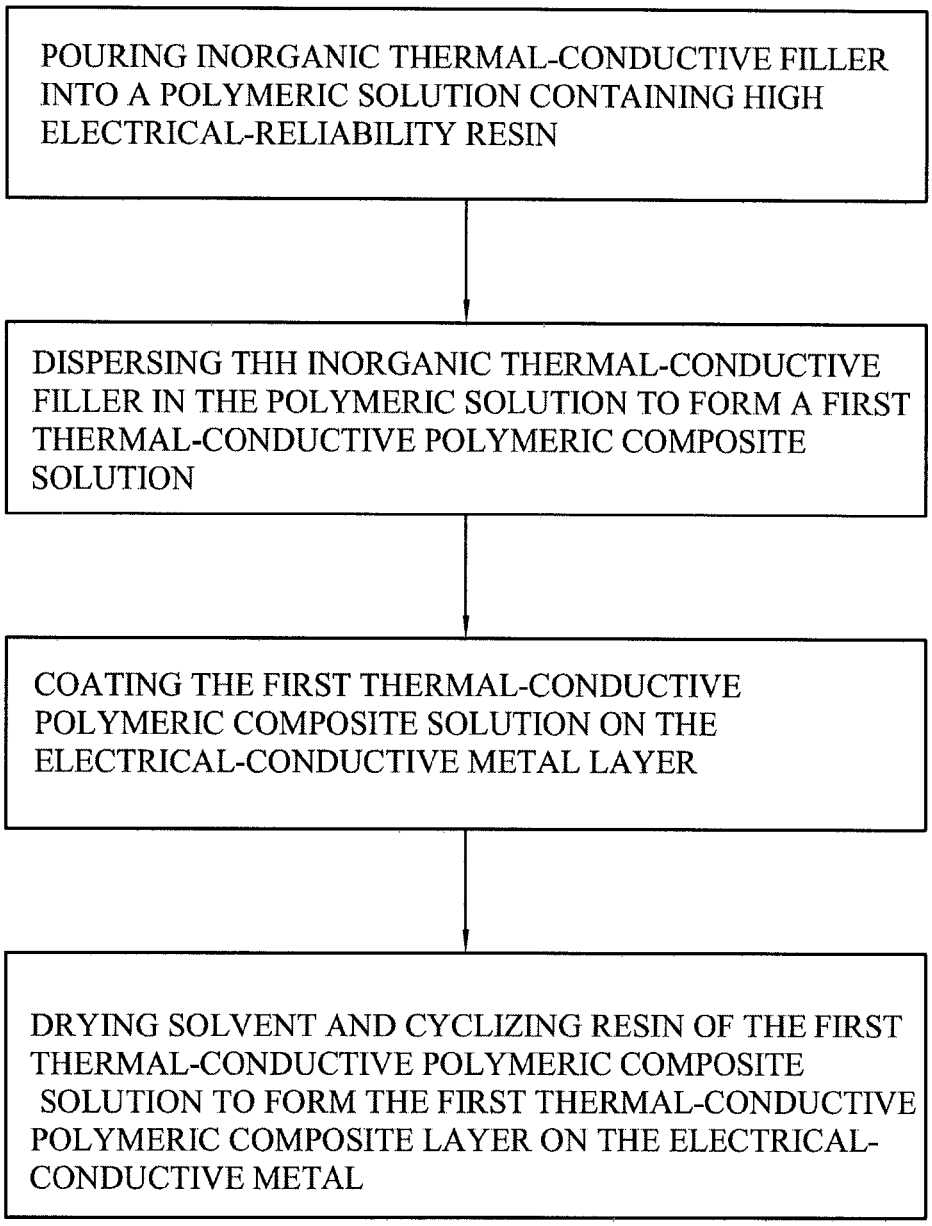
FIG. 3 is a flow chart of a method for manufacturing a first thermal-conductive polymeric composite layer which provides higher electrical reliability in accordance with the present invention.

With reference to FIG. 3, the step of forming a first thermal-conductive polymeric composite layer comprises pouring inorganic thermal-conductive filler into a polymeric solution containing high electrical-reliability resin, dispersing the inorganic thermal-conductive filler in the polymeric solution with general blending homogenizer to form a first thermal-conductive polymeric composite solution, coating the first thermal-conductive polymeric composite solution on the electrical-conductive metal layer, drying solvent and cycliz-ing resin of the first thermal-conductive polymeric composite solution at 140~350° C. for 30~60 minutes to form the first thermal-conductive polymeric composite layer on the electrical-conductive metal layer. The inorganic thermal-conductive filler is less than 50 vol. % of the first thermal-conductive polymeric composite layer, and the average particle size of filler is less than 10 μm. The inorganic thermal-conductive filler is selected from the group consisting of inorganic nitride compound, inorganic oxide compound and silicon carbide. The high electrical reliability resin, polyimide, is obtained from a polyamic acid solution after drying and cyclization.

Figure 4:
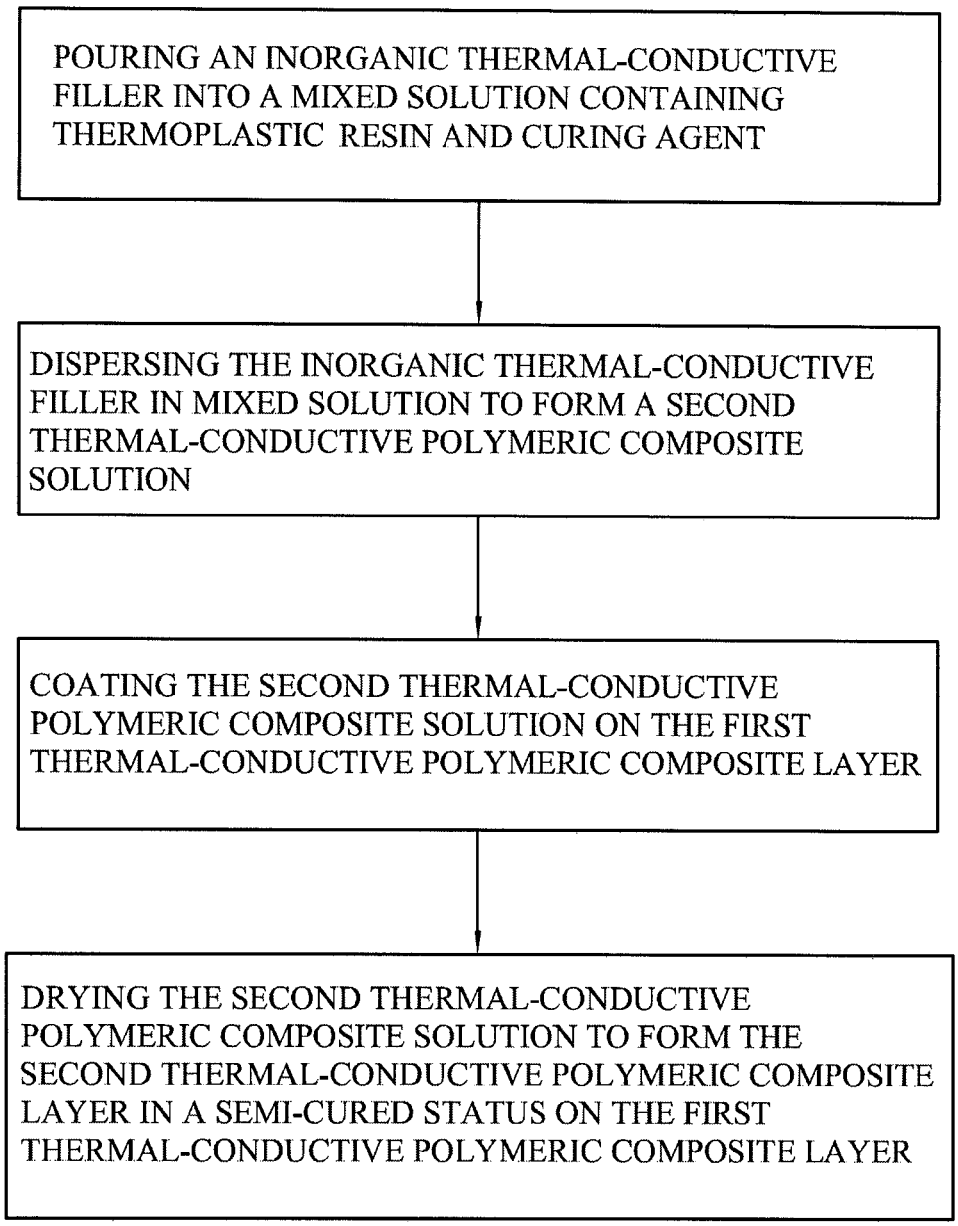
FIG. 4 is a flow chart of a method for manufacturing a second thermal-conductive polymeric composite layer which provides a lower temperature hot-pressing function in accordance with the present invention.

With reference to FIG. 4, the step of forming a second thermal-conductive polymeric composite layer comprises pouring an inorganic thermal-conductive filler into a mixed solution containing thermoplastic resin, thermosetting resin and curing agent, dispersing the inorganic thermal-conductive filler in mixed solution to form a second thermal-conductive polymeric composite solution, coating the second thermal-conductive polymeric composite solution on the first thermal-conductive polymeric composite layer opposite to the electrical-conductive metal layer, and drying the second thermal-conductive polymeric composite solution at 100~160° C. for 1~3 minutes to form the second thermal-conductive polymeric composite layer in a semi-cured status on the first thermal-conductive polymeric composite layer. The amount of the inorganic thermal-conductive filler is 20~70 vol. % of the second thermal-conductive polymeric composite layer and the inorganic thermal-conductive filler is selected from the group consisting of inorganic nitride compound, inorganic oxide compound and silicon carbide. A glass transition temperature (Tg) of the second thermal-conductive layer is below 120° C. The thermoplastic resin contains reactive functional group being selected from the group consisting of carboxy, amine and hydroxy group. The thermoplastic resin is selected from the group consisting of acrylic copolymer, butadiene copolymer, polystyrene copolymer and polyamide, which individually have a Tg lower than 90° C. The thermosetting resin can be cross-linked with the curing agent, the thermoplastic resin or the thermosetting resin itself to form a network polymer. The thermosetting resin is epoxide and may include more than two epoxy groups and has an epoxy equivalent weight of 100~5000 g/eq. The curing agent is selected from the group consisting of an aromatic group and aliphatic group containing more than two reactive functional groups. The reactive functional group includes carboxy group, anhydride group, amine, hydroxy group or isocyanate. The curing agent can be cross-linked with the thermoplastic resin to form the semi-cured polymer or with the thermosetting resin to form the network polymer.

The step of pressing a thermal-conductive metal layer comprises providing a thermal-conductive metal substrate, mounting the thermal-conductive metal substrate on the second thermal-conductive polymeric composite layer, hot-pressing the thermal-conductive metal substrate to the second heat-conductive polymeric composite layer at 120~190° C. and under 55~95 $Kg_f/cm^2$ for 1~2 minutes to melt the second thermal-conductive polymeric composite layer for adhering the heat-conductive metal substrate to the second heat-conductive polymeric composite layer to form a pretreated low thermal-impedance insulated metal substrate, and curing the pretreated low thermal-impedance insulated metal substrate at 160~200° C. for 2~8 hours to obtain the low thermal-impedance insulated metal substrate. A fully-cured polymer is formed from the semi-cured polymer.

The present invention uses coating technology, so no voids or pores are formed between the electrical-conductive metal layer and the first thermal-conductive polymeric composite layer and between the second thermal-conductive polymeric composite layer and the thermal-conductive metal layer. Accordingly, the foregoing advantage in the first and third conventional methods can be solved.

Furthermore, coating technology facilitates the first and second thermal-conductive polymeric composite layers to respectively penetrate into the electrical-conductive metal layer and the thermal-conductive metal layer. Therefore, peel strengths between them can be increased.

Moreover, because the second thermal-conductive polymeric composite layer is semi-cured before the thermal-conductive metal layer is pressed thereon, the second thermal-conductive polymeric composite layer has poor flow ability.

Therefore, the resin-flow phenomenon can be avoided during the second thermal-conductive polymeric composite layer hot-pressing process, thereby solving the foregoing problem of the second conventional method in the prior art.

Figure 2:
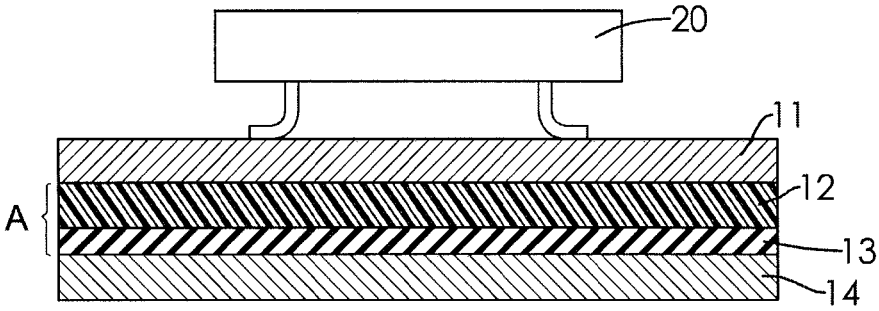
FIG. 2 is a cross sectional side view of a low thermal-impedance insulated metal substrate in accordance with the present invention.
Figure 5:
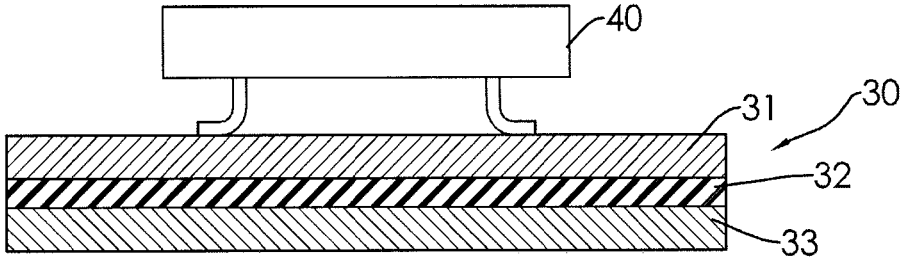
FIG.5 PRIOR ART
FIG. 5 is a cross sectional side view of a conventional insulated metal substrate in accordance with the prior art.

With reference to FIG. 2, the low thermal-impedance insulated metal substrate (10) in accordance with the present invention is attached to an electronic element (20) and has an electrical-conductive metal layer (11), a first thermal-conductive polymeric composite layer (12), a second thermal-conductive polymeric composite layer (13) and a thermal-conductive metal layer (14).

The electrical-conductive metal layer (11) is used to hold the electronic element (20) to transfer heat from the electronic element (20) to heat-sink module and may be etched with a circuit pattern. The electrical-conductive metal layer (11) is made of material known to those with ordinary skill in the art.

The first thermal-conductive polymeric composite layer (12) is formed on the electrical-conductive metal layer (11) and has a thickness of 1~25 pun, a thermal-impedance less than 0.13° C.-in$^2$/W and a glass transition temperature (Tg) higher than 200° C. The first thermal-conductive polymeric composite layer (12) provides higher electrical reliability.

The second thermal-conductive polymeric composite layer (13) is formed on the first thermal-conductive polymeric composite layer (12) and has a thickness of 1~65 μm and a thermal-impedance less than 0.10° C.-in$^2$/W. The second thermal-conductive polymeric composite layer (13) is suitable to be adhered to other material or layer by hot-pressing process at a lower temperature.

The thermal-conductive metal layer (14) is adhered on the second thermal-conductive polymeric composite layer (13) by hot-pressing process, wherein a total thickness of the first and second thermal-conductive polymeric composite layers (12, 13) is larger than 15 μm.

Most preferably, a total thickness of the first and second thermal-conductive polymeric composite layers (12, 13) is less than 75 μm.

Preferably, an overall thermal-impedance of the first and second thermal-conductive polymeric composite layers (12, 13) is less than 0.10° C.-in$^2$/W.

Preferably, an overall coefficient of thermal expansion (CTE) of the first and second thermal-conductive polymeric composite layers (12, 13) is less than 30 ppm/° C. below 120° C. and is less than 50 ppm/° C. above 120° C. Therefore, the low thermal-impedance insulated metal substrate (10) has good dimensional stability.

Preferably, a total breakdown voltage of the first and second thermal-conductive polymeric composite layers (12, 13) is larger than 3000 volt or is larger than 1.70 KV/mil. Therefore, the low thermal-impedance insulated metal substrate (10) has increased electrical reliability.

Preferably, a total volume resistance of the first and second thermal-conductive polymeric composite layers (12, 13) is larger than $10^{13}$ Ωcm. Therefore, the low thermal-impedance insulated metal substrate (10) displays excellent electrical insulation properties.

Preferably, a peel-strength of each interface of layers is larger than 1 $Kg_f$/cm.

Preferably, the low thermal-impedance insulated metal substrate (10) endures being immersed in solder at 288° C. for more than 10 seconds. Therefore, the low thermal-impedance insulated metal substrate (10) has improved thermal stability.

The second thermal-conductive polymeric composite layer (13) provides elongation which is able to release the thermal stress between electrical-conductive metal layer (11) and the thermal-conductive metal layer (14) during a heat cycle test. Therefore, the low thermal-impedance insulated metal substrate (10) of the present invention has lower thermal-impedance, lower coefficient of thermal expansion and higher electrical reliability.

EXAMPLE

The first and second thermal-conductive polymeric composite layers improve the properties of the low thermal-impedance insulated metal substrate of the present invention. Therefore, the following examples show the individual properties of the first and second thermal-conductive polymeric composite layers and resulting properties of the thermal-conductive substrate. The first and second thermal-conductive polymeric composite layers in the following examples are referred to as a "dielectric layer".

Table 1 shows an introduction of properties considered in the present invention. Among others, 0.5 Oz. of rolled anneal copper foil was used for peel strength test between the dielectric layer and metal layers which include the electrical-conductive metal layer and the thermal-conductive metal layer.

TABLE 1

Introduction of Tests

| FACTOR | OBJECT | Detected standard or apparatus |
|---|---|---|
| Total thickness of dielectric layer | Total thickness was measured to calculate thermal-impedance. | ASTM D1005 |
| Thermal conductivity of dielectric layer | Thermal conductivity was measured to obtain thermal-conductive effect and to calculate thermal-impedance. | ASTM E1461 ASTM D5470 |
| thermal-impedance dielectric layer | Thermal-impedance was calculated according to the total thickness and the thermal conductivity using heat conduction theory. | Using ASTM E1461 and ASTM D1005 for calculation |
| Breakdown voltage of dielectric layer | Electrical reliability of the low thermal-impedance insulated metal substrate was proved. | IPC-TM-650 NO. 2.5.6 |
| Peel strength of each interface (Peel strength between the second | Peel strength between each metal layers and dielectric layer were measured. Peel strength between the | IPC-TM-650 NO. 2.4.9 |

TABLE 1-continued

| Introduction of Tests | | |
|---|---|---|
| FACTOR | OBJECT | Detected standard or apparatus |
| thermal-conductive polymeric composite layer and the thermal-conductive metal layer) | thermal-conductive polymeric composite layers was measured. | |
| Coefficient of thermal expansion of dielectric layer | Dimensional stability of dielectric layer was obtained. | ASTM E 831 |
| Solder-reflow test for the low thermal-impedance insulated metal substrate | Thermal stability of the low thermal-impedance insulated metal substrate was obtained. | IPC-TM-650 NO. 2.4.13 |

Ingredients of the first and second thermal-conductive polymeric composite layers in Examples 1 to 3 of the present invention are shown in table 2.

The resin of the first thermal-conductive polymeric composite layer in example 1 to 3 is Polyimide. Polyimide resin was obtained from a polyamic acid/1-methyl-2-pyrrolidone (NMP) solution after drying and cyclization at increased temperature. Inorganic thermal-conductive filler was not added in the first thermal-conductive polymeric composite layer of example 1; 18 vol. % of aluminum nitride (AlN) was added in the first thermal-conductive polymeric composite layer of example 2; 25 vol. % of hexagonal boron nitride (h-BN) was added in the first thermal-conductive polymeric composite layer of example 3. Thicknesses of the first thermal-conductive polymeric composite layers of examples 1 to 3 respectively were 12 μm, 18 μm and 18 μm.

Thermoplastic resins in the composite solutions of examples 1 to 3 all were the rubber of butadiene copolymer; curing agent all were aromatic amine with multi-functional group; and inorganic thermal-conductive filler all were MN and individually is 40 vol. % in the second thermal-conductive polymeric composite layer. Thicknesses of the second thermal-conductive polymeric composite layers of examples 1 to 3 were 37 μm, 29 μm and 40 μm respectively.

TABLE 2

| Examples | | | | |
|---|---|---|---|---|
| FACTOR | | Example 1 | Example 2 | Example 3 |
| First heat-conductive polymeric composite layer | Volume percentage of Polyimide resin (vol. %) | 100 | 82 | 75 |
| | Type of inorganic thermal-conductive filler | — | AlN | h-BN |
| | Volume percentage of inorganic thermal-conductive filler (vol. %) | 0 | 18 | 25 |
| | Thickness (μm) | 12 | 18 | 18 |
| Second heat-conductive polymeric composite layer | Volume percentage of composite resin (vol. %) | 60 | 60 | 60 |
| | Type of inorganic thermal-conductive filler | AlN | AlN | AlN |
| | Volume percentage of inorganic thermal-conductive filler (vol. %) | 40 | 40 | 40 |
| | Thickness (μm) | 37 | 29 | 40 |
| Total thickness of dielectric layer (μm) | | 49 | 47 | 58 |
| Thermal conductivity of dielectric layer (W/m-K) (ASTM E1461) | | 0.90 | 1.38 | 1.55 |
| Thermal-impedance (° C.-in.$^2$/W) | | 0.084 | 0.053 | 0.058 |
| Breakdown voltage (KV) | | 6.93 | 3.20 | 4.63 |
| Breakdown voltage per mil (KV/mil) | | 3.54 | 1.70 | 1.99 |
| Peel strength of each interface (Kg/cm) | | 1.084 | 1.008 | 1.030 |
| Coefficient of thermal expansion (ppm/° C.) (40~150° C.) | | 15~19 | 8~17 | 14~28 |
| Properties of low thermal-impedance insulated metal substrate | | | | |
| Solder-reflow test (288° C./10 sec.) | | Pass | Pass | Pass |

Comparative examples 1 to 3 are shown in table 3 to compare with the present invention. All data in the comparative examples 1 to 3 were respectively obtained from catalog of Denka, Laird and Bergquist.

TABLE 3

| FACTOR | Comparative example 1 | Comparative example 2 | Comparative example 3 |
|---|---|---|---|
| Comparative examples | | | |
| Factory owner/type | Denka/K-1 | Laird/1KA04 | Bergquist/ HT-04503 |
| Total thickness of dielectric layer (μm) | 100 | 102 | 75 |
| Thermal conductivity of dielectric layer (W/m-K) | 2.0(ASTM E1461) | 3.0(ASTM D5470) | 2.2(ASTM D5470) |
| Thermal-impedance (° C.-in.$^2$/W) | 0.079 | 0.053 | 0.053 |
| Breakdown voltage (KV) | 6.8 | 3.2 | 6.0 |
| Breakdown voltage per mil (KV/mil) | 1.70 | 0.80 | 2.00 |
| Peel strength of each interface ($Kg_f$/cm) | 2.57 | 0.80 | 0.80 |
| Coefficient of thermal expansion (ppm/° C.) | 78 | 32/81 (<Tg/>Tg) | 25/95 (<Tg/>Tg) |
| Properties of low thermal-impedance insulated metal substrate | | | |
| Solder-reflow test (288° C./10 sec.) | Pass | Pass | Pass |

Comparing example 1 of the present invention and comparative example 1, there was no inorganic thermal-conductive filler in example 1 of the present invention, and the total thickness of the dielectric layer is half of that in comparative example 1. The thermal-impedance of example 1 of the present invention was approached to comparative example 1 (about 0.08° C.-in.$^2$/W), but the breakdown voltage (3.54 KV/mil.) in example 1 of the present invention was 2.08 times higher than that in comparative example 1 (1.70 KV/mil.). Therefore, the dielectric layer of low thermal-impedance insulated metal substrate of example 1 is able to achieve the approached thermal-impedance and higher electrical reliability with half relative thickness.

Comparing example 2 of the present invention and comparative example 2, the total thickness of the dielectric layer is half of that in comparative example 2. Example 2 of the present invention and comparative example 2 have the same thermal-impedance (0.053° C.-in.$^2$/W), but the breakdown voltage (1.7 KV/mil.) in example 2 of the present invention was 2.125 times higher than that in comparative example 2 (0.8 KV/mil.). Therefore, after MN was added, thermal conductivity of the dielectric layer was increased to decrease the thermal-impedance while high electrical reliability was retained.

Comparing example 3 of the present invention and comparative example 2, the total thickness of the dielectric layer is 0.6 times of that in comparative example 2. The thermal-impedance of example 3 of the present invention was approached to comparative example 2 (about 0.05° C.-in.$^2$/W), but the breakdown voltage (1.99 KV/mil.) in example 3 of the present invention was 2.5 times higher than that in comparative example 2 (0.8 KV/mil.).

Comparing example 3 of the present invention and comparative example 3, the total thickness of the dielectric layer is 0.77 times of that in comparative example 3. The thermal-impedance and breakdown voltage of example 3 of the present invention were approached to comparative example 3 (about 0.05° C.-in.$^2$/W and 2.0 KV/mil, respectively). Therefore, when h-BN was added in the first thermal-conductive polymeric composite layer, thermal conductivity and electrical reliability can be improved.

Moreover, peel strength of each interface of layers in the examples 1 to 3 of the present invention was higher than 1 $Kg_f$/cm and each coefficient of thermal expansion in the examples 1 to 3 was lower than 30 ppm/° C., which was lower than each coefficient of thermal expansion in the comparative examples 1 to 3. Therefore, the present invention has a higher dimensional stability than comparative examples 1 to 3.

Accordingly, the first thermal-conductive polymeric composite layer is provided to retain the electrical reliability of the low thermal-impedance insulated metal substrate. Thicknesses of the dielectric layer can be reduced to decrease the thermal-impedance. Content of the inorganic thermal-conductive filler in the dielectric layer can be adjusted. While the content of inorganic thermal-conductive filler is decreased, the mechanical property of the dielectric layer can be increased.

Therefore, the low thermal-impedance insulated metal substrate of the present invention has lower thermal-impedance, lower coefficient of thermal expansion and higher electrical reliability and is adapted to hold electrical elements. Even when temperature of the low thermal-impedance insulated metal substrate is raised, it remains dimensionally and thermally reliable.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A low thermal-impedance insulated metal substrate, comprising:

an electrical-conductive metal layer;

a first thermal-conductive polymeric composite layer formed on the electrical-conductive metal layer and having a thickness of 1~25 μm, a thermal-impedance less than 0.13° C.-in$^2$/W and a glass transition temperature (Tg) higher than 200° C.;

a second thermal-conductive polymeric composite layer formed on the first thermal-conductive polymeric composite layer and having a thickness of 1~65 μm and a thermal-impedance less than 0.10° C.-in$^2$/W; and a thermal-conductive metal layer adhered to the second thermal-conductive polymeric composite layer by a pressing process;

wherein a total thickness of the first and second thermal-conductive polymeric composite layers is larger than 15 μm.

2. The low thermal-impedance insulated metal substrate as claimed in claim 1, wherein a total thickness of the first and second thermal-conductive polymeric composite layers is less than 75 μm.

3. The low thermal-impedance insulated metal substrate as claimed in claim 1, wherein an overall thermal-impedance of the first and second thermal-conductive polymeric composite layers is less than 0.10° C.-in$^2$/W.

4. The low thermal-impedance insulated metal substrate as claimed in claim 1, wherein an overall coefficient of thermal expansion of the first and second thermal-conductive polymeric composite layers is less than 30 ppm/° C. below 120° C. and is less than 50 ppm/° C. above 120° C.

5. The low thermal-impedance insulated metal substrate as claimed in claim 1, wherein a total breakdown voltage of the first and second thermal-conductive polymeric composite layers is larger than 3000 volts.

6. The thermal-conductive substrate as claimed in claim 1, wherein a total volume resistance of the first and second thermal-conductive polymeric composite layers is larger than $10^{13}$ Ωcm.

7. The low thermal-impedance insulated metal substrate as claimed in claim 1, wherein a peel strength between each interface of layers is larger than 1 $Kg_f$/cm.

8. The low thermal-impedance insulated metal substrate as claimed in claim 1, wherein the low thermal-impedance insulated metal substrate is endurable for being immersed in solder at 288° C. for more than 10 seconds.

* * * * *